US007037171B2

(12) United States Patent
Clark et al.

(10) Patent No.: US 7,037,171 B2
(45) Date of Patent: May 2, 2006

(54) ENTERTAINMENT DEVICE

(75) Inventors: Bradley M. Clark, Orchard Park, NY (US); Robert J. Sonner, South Wales, NY (US)

(73) Assignee: Mattel, Inc., El Segundo, CA (US)

( * ) Notice: Subject to any disclaimer, the term of this patent is extended or adjusted under 35 U.S.C. 154(b) by 209 days.

(21) Appl. No.: 10/819,291

(22) Filed: Apr. 7, 2004

(65) Prior Publication Data

US 2005/0227578 A1 Oct. 13, 2005

(51) Int. Cl.
*A63H 17/22* (2006.01)

(52) U.S. Cl. ..... 446/435; 446/308

(58) Field of Classification Search ..... 446/411–413, 446/168, 173, 174, 269, 272, 274, 292, 435
See application file for complete search history.

(56) References Cited

U.S. PATENT DOCUMENTS

| | | | | | |
|---|---|---|---|---|---|
| 2,462,686 | A | * | 2/1949 | Stallard | 273/145 D |
| 2,475,306 | A | | 7/1949 | Beder | |
| 2,919,921 | A | * | 1/1960 | Berger | 273/145 D |
| 3,264,782 | A | | 8/1966 | Glass et al. | |
| 4,103,455 | A | | 8/1978 | Silvey | |
| 4,108,431 | A | * | 8/1978 | Camara | 273/145 D |
| 4,312,149 | A | | 1/1982 | Iwao | |
| 4,424,978 | A | * | 1/1984 | Kassai | 446/290 |
| 4,610,637 | A | * | 9/1986 | Ferguson | 446/237 |
| 4,693,697 | A | | 9/1987 | Pagano | |
| 4,757,999 | A | * | 7/1988 | Opresco | 273/145 CA |
| 5,064,399 | A | * | 11/1991 | Klitsner et al. | 446/308 |
| 5,120,263 | A | * | 6/1992 | Ierfino et al. | 446/486 |
| 5,449,174 | A | * | 9/1995 | Criner | 273/145 D |
| 5,615,900 | A | | 4/1997 | Gaportsin | |
| 6,027,395 | A | | 2/2000 | Strom | |
| 6,099,417 | A | * | 8/2000 | Brown et al. | 473/417 |
| 6,474,659 | B1 | | 11/2002 | Horchler | |
| 6,736,400 | B1 | * | 5/2004 | Cesternino | 273/366 |

OTHER PUBLICATIONS

Counting Corn Popper, Fisher-Price Product No. 77887, http://www.fisher-price.com/us/products/product.asp?id=5536, Apr. 5, 2004.

Corn Popper, Fisher-Price Product No. 72011, http://www.fisher-price.com/us/products/product.asp?id=199, Apr. 5, 2004.

* cited by examiner

*Primary Examiner*—Kien Nguyen
(74) *Attorney, Agent, or Firm*—Edell, Shapiro & Finnan, LLC

(57) ABSTRACT

An entertainment device for use with at least one toy block is provided, wherein the entertainment device comprises a housing including a block support surface for the at least one toy block. The at least one toy block includes at least first and second planar surfaces adapted to contact the block support surface. The entertainment devices includes a block reorientation mechanism attached to the housing, the block reorientation mechanism being capable of (1) moving the block off of the block support surface from a first position in which the first surface of the block is in contact with the block support surface and (2) reorienting the block to a second position in which the second surface of the block is in contact with the block support surface.

36 Claims, 8 Drawing Sheets

ENTERTAINMENT DEVICE

FIELD OF THE INVENTION

The present invention relates to an entertainment device and, more particularly, to an entertainment device for use with toy blocks, wherein the device includes a toy block reorientation mechanism.

BACKGROUND

Children enjoy toys that can be pushed or pulled. The attention span of young children, however, is short, and a simple push-pull toy will not sustain a child's interest. Consequently, ancillary features have been incorporated into push-pull toys. For example, motion mechanisms have been connected to push/pull toys and utilized to move a portion of the toy in response to actuation of the motion mechanism. Furthermore, motion mechanisms have been connected to the wheels of push/pull toys such that movement of the push/pull toy across a support surface actuates the motion mechanism to move a portion of the toy. The use of such motion mechanisms, however, generally entails fixing the moving portion of the toy to the main body of the toy, or enclosing unattached accessories within a transparent dome or container (such as in the classic popcorn popper push toys). Such conventional toys may prevent the child from fulfilling her natural explorative instincts in separating one portion of the toy from another portion of the toy and recombining the same.

Thus, it would be desirable to provide push/pull toy that imparts motion to removable, interactive accessories. In particular, it would be desirable to provide a push/pull toy that imparts a controlled motion to an accessory that is not attached to the push/pull toy. Such accessory motion would enhance the entertainment value of the toy, since both the toy and the accessory would provide unique sources of entertainment, which would then be magnified when used together.

Thus, there exists a need for providing an entertainment device that imparts a controlled motion to an unattached accessory. Furthermore, there exists a need for a push/pull device that imparts a controlled motion to an unattached accessory when the device is pushed or pulled along a surface. Providing a highly-controlled motion to the unattached accessory not only increases a child's enjoyment, but also lessens the likelihood of the unattached accessory becoming lost due to its falling off of the device.

This invention is directed generally to a toy wherein movement of the toy across a support surface imparts a controlled motion to an unattached member carried by the toy. More specifically, this invention is directed to a toy vehicle wherein movement of the toy vehicle across a support surface imparts a controlled motion to an unattached toy block carried by the toy vehicle.

SUMMARY

Generally, the embodiments of the present invention provide an infant entertainment device or toy and, more particularly, an entertainment device or toy for use with separate toy blocks including a block reorientation mechanism.

BRIEF DESCRIPTION OF THE DRAWINGS

Like reference numerals have been used to identify like elements throughout this disclosure.

DETAILED DESCRIPTION

In accordance with the present invention, an entertainment device for use with at least one toy block is disclosed. An embodiment of the entertainment device of the present invention comprises a housing that includes a block support surface and a block reorientation mechanism. The block reorientation mechanism of an embodiment of the present invention is adapted to propel the block off of the block support surface, reorient the block, and to allow the block to return to the support surface.

Figure 1:
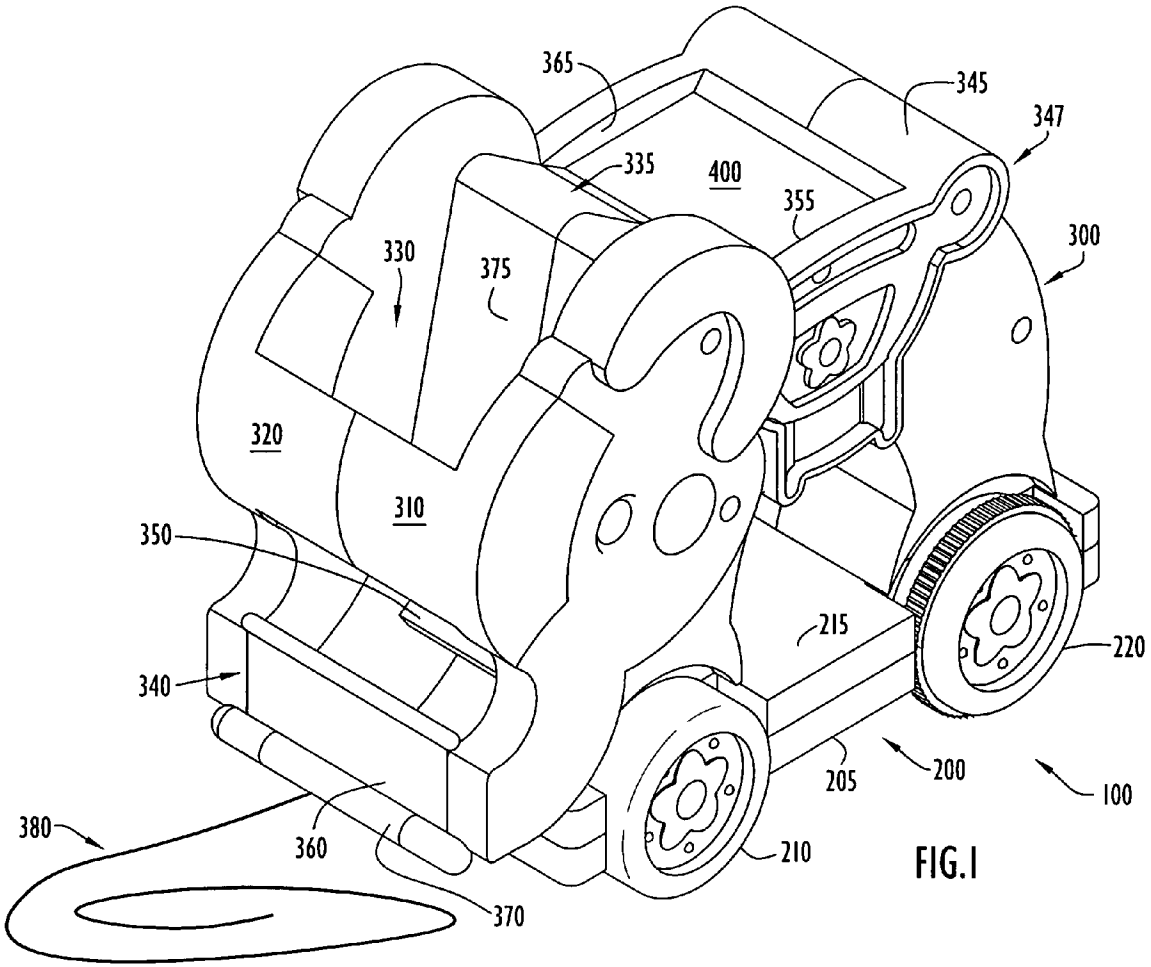
FIG. 1 illustrates a perspective view of an entertainment device according to an embodiment of the invention.
Figure 2:
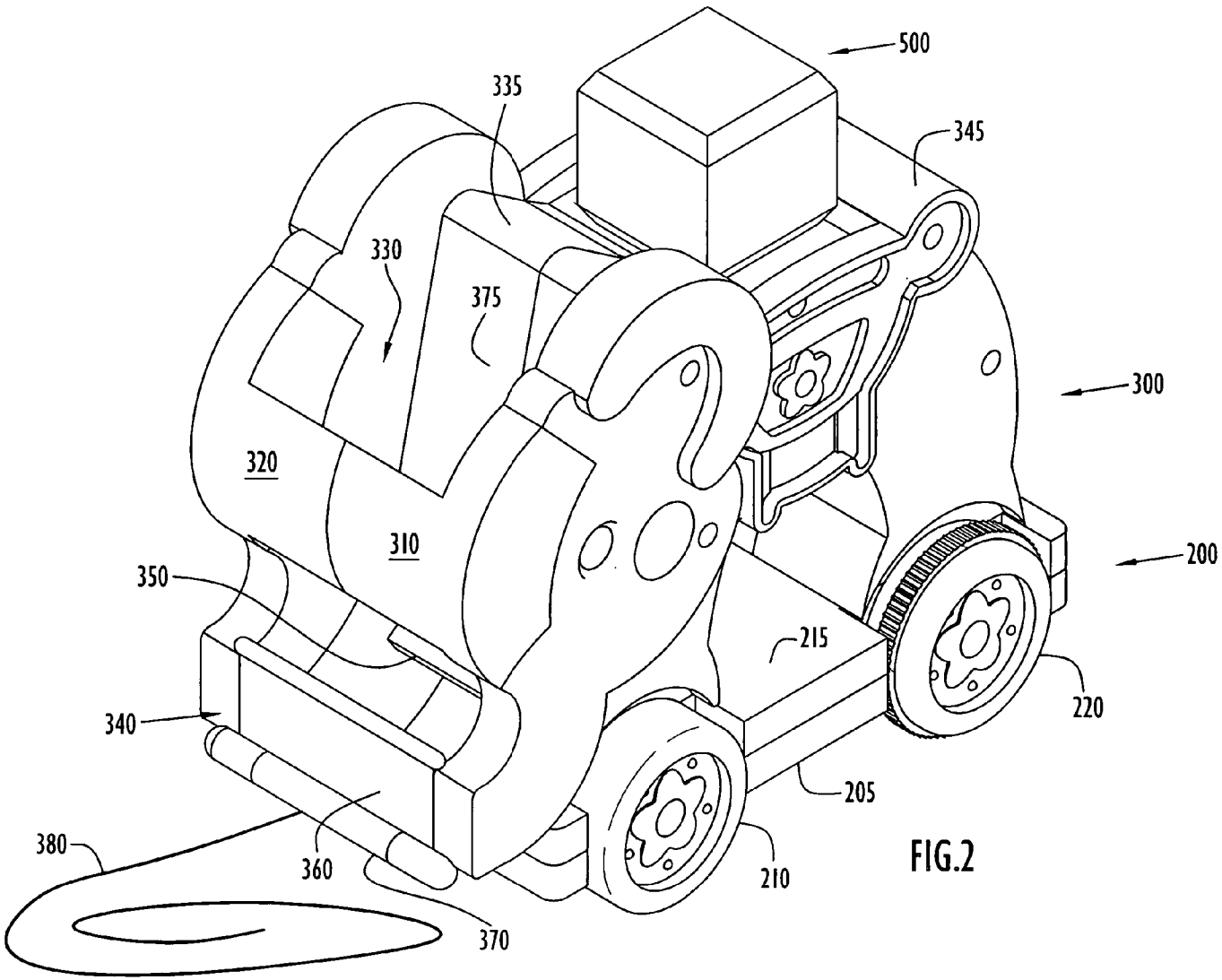
FIG. 2 illustrates a perspective view of the embodiment of FIG. 1, further including an unattached block accessory and its placement on the device.

An entertainment device according to an embodiment of the invention is illustrated in FIGS. 1 and 2. FIG. 1 illustrates a perspective view of an entertainment device according to an embodiment of the invention and FIG. 2 illustrates a perspective view of the embodiment of FIG. 1, further including an unattached block accessory and its placement on the device. The entertainment device 100 may comprise a base 200 and a housing 300 including a block reorientation mechanism 400. Base 200 may comprise a structure that stabilizes and supports housing 300. Base 200 may be of any shape or size. By way of non-limiting example, base 200 may include a rectangular shape. In the embodiment of FIG. 1, base 200 includes a generally planar lower platform or section 205 and a generally planar upper platform or section 215. Lower 205 and upper 215 platforms can be separable, and can be secured using conventional securing devices (e.g. screws, bolts, nuts, adhesives, etc). Base 200 may further include a pair of front wheels 210 and a pair of rear wheels 220 rotatably mounted on an axle, for example, between upper 215 and lower 205 platforms. Wheel pairs 210, 220 enable device 100 to roll along a surface. In addition, wheel pairs 210, 220 may be used to activate block reorientation mechanism 400 of device 100 (described in more specific detail below). Base 200 may further include electronic circuitry (not shown) for generating sensory stimulating entertainment features such as lights, music, and sound effects.

Housing 300 may comprise a generally hollow structure that contains various mechanical and electrical components of device 100, including reorientation mechanism 400. The size and shape of housing 300 is not limited, and may comprise any geometric shape, character, or animal. In addition, housing 300 may comprise a unitary structure or may include separable sections. By way of non-limiting example, housing 300 may be stylized as an elephant including two separable body sections 310 and 320. As shown in FIGS. 1 and 2, housing 300 may include a left housing section 310 and a right housing section 320, wherein left section 310 and right section 320 are mirror images of each other (i.e., sections 310, 320 may be configured to represent the left and right sides of an elephant, respectively).

Housing 300 may further include a chute or channel 330 located along the front of housing 300. Chute 330 includes a travel path running from the top of housing 300 (i.e., the top of the elephant) down to the support surface (i.e., the surface along which the toy is pushed or pulled). The shape, length, and diameter of chute 330 are not limited to those illustrated herein. Referring to FIGS. 1 and 2, chute 330 may include a curved back wall or slide 375. With this configuration, a user may place a block accessory 500 into the chute 330 (e.g., at the opening located near the top of the housing) so that it slides down chute 330 towards an exit 340. The curved slide 375 of chute 330 may further contain a mechanical switch 350 that is engaged by block 500 as it travels down chute 330. Switch 350 may include any type of known switch, including, but not limited to a mechanical pressure switch, an optical switch (photosensor), or some other type of switch actuated by the passage of block accessory 500 through chute 330. Switch 350 may be connected to a circuit board that, when activated, generates sensory stimulating electronic entertainment features such as such as lights, music, and sound effects (e.g., animal sounds or educational verbalizations).

At the exit 340 of chute 330, a gate 360 is pivotally connected to a pivot axle 370. With this configuration, gate 360 may be pivoted from a horizontal, open position to a vertical, closed position (as illustrated), and vice versa. In the illustrated closed position, gate 360 completely covers exit 340, impeding the travel of block accessory 500 through exit 340. This configuration enables a user to place one or more blocks 500 within the chute 330 for storage.

Housing 300 contains the block reorientation mechanism 400 (which is explained in further detail below). Housing 300 further includes a front wall 335, a rear wall 345, a left wall 355, and a right wall 365 extending upwardly from block reorientation mechanism 400. Preferably, the walls 335, 345, 355, and 365 extend at an upward and outward angle relative to mechanism 400. This configuration helps to maintain the block accessory in proximity to the block reorientation mechanism 400 during the reorientation process (explained in greater detail below). Rear wall 345 may further include a rounded portion 347 (as labeled in FIGS. 5–8) that may serve as a handle allowing a user to push device 100, moving it along a surface. In addition, housing 300 may also have an appendage 380 attached to it, which may be used to apply a pulling force to device 100. Appendage 380 may be a string, rope, rigid handle, or any other appropriate device that would allow a user to apply a pulling force to device 100.

As illustrated in FIG. 2, the block accessory 500 may include various shapes. By way of a non-limiting example, block 500 may be cubical in shape. Block 500 may be adapted to contact a support surface of block reorientation mechanism 400. Block 500 preferably includes at least two planar sides. The non-limiting example of block 500 shown in FIG. 2 includes six planar sides and beveled edges. Preferably, block 500 may be one of a set of multiple blocks that are capable of being stacked, one upon another. A preferred, commercially available block is the Peek-a-Blocks™ series of stacking blocks available from Fisher-Price, Inc. of East Aurora, N.Y. It is understood, however, that the size, shape, or type of block is not limited to those disclosed herein.

Figure 3:
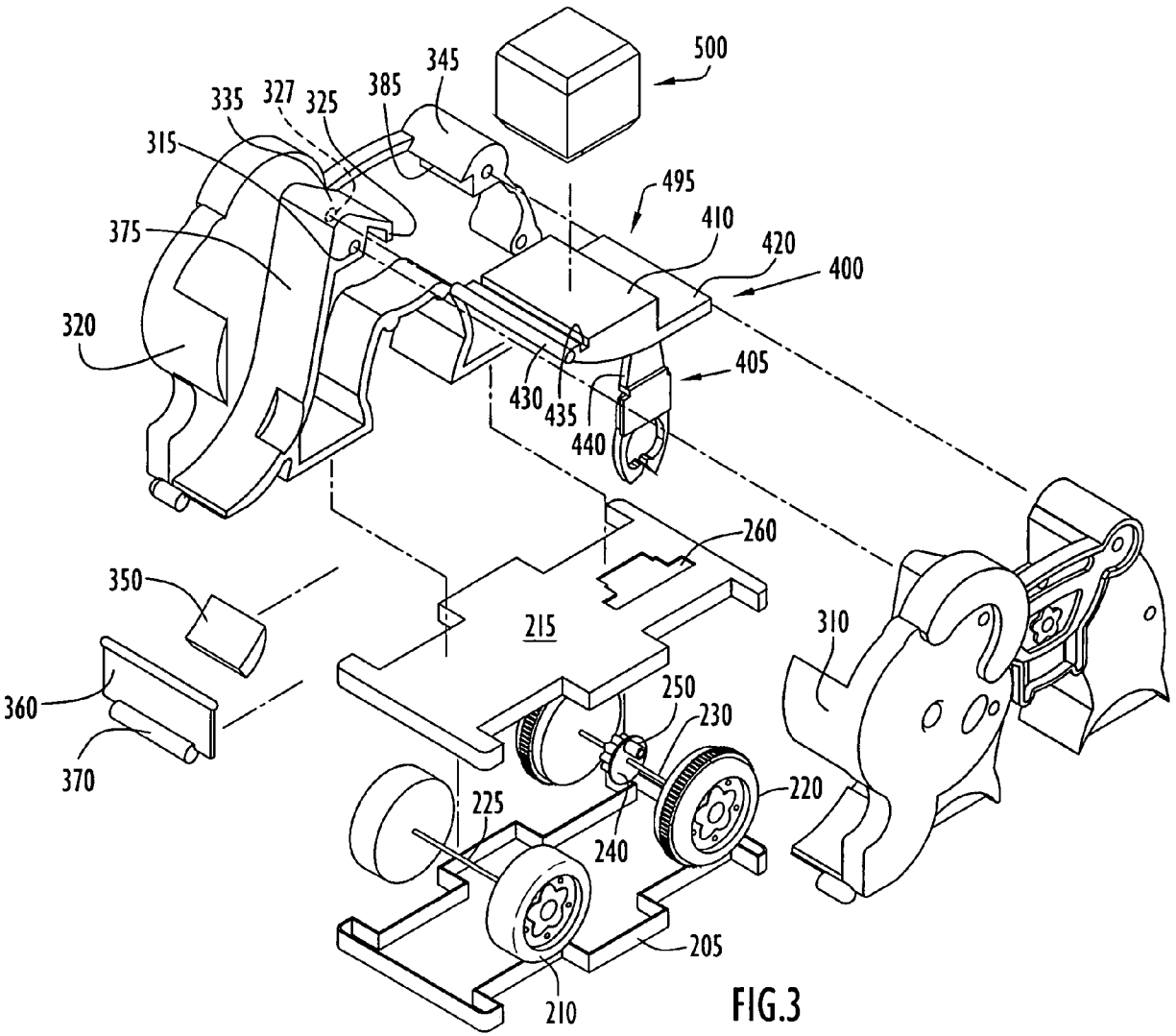
FIG. 3 illustrates an exploded perspective view of the device of FIG. 2.

FIG. 3 illustrates an exploded perspective view of the device of FIG. 2. This illustration shows the lower 205 and upper 215 platforms of base 200, as well as front 210 and rear 220 wheel pairs rotatably mounted on axles between the platforms 205, 215. Front wheel pair 210 includes a left wheel and a right wheel fixedly attached to a front axle 225. Similarly, rear wheel pair 220 includes a left wheel and a right wheel fixedly attached to a rear axle 230. Rear axle 230 further includes a gear 240 mounted to the axle 230. Gear 240 is positioned approximately at the center point of axle 230. Gear 240 includes an offset boss 250 configured to engage reorientation actuator 405 of block reorientation mechanism 400, described below. Upper platform 215 may further include an opening 260 positioned to permit passage of the proximal end of reorientation actuator 405 through the platform 215 and into base 200, such that it may engage gear 240 on axle 230.

FIG. 3 also illustrates the left 310 and right 320 housing sections. Left section 310 and right section 320 may be connected in any conventional manner. As a non-limiting example, the sections 310, 320 may be connected using screws (not shown) inserted into screw receptacles, shown for example at, 315. The sections 310, 320 may also be secured using other conventional securing devices (e.g. bolts, nuts, adhesives, etc.).

As mentioned above, block reorientation mechanism 400 is positioned within housing 300, and may comprise a block support member 495 and a reorientation actuator 405. In a preferred embodiment, block support member 495 includes a block support surface 410 and a stop member or flange 420 that extends horizontally from the lower rear side of block support surface 410. Block support surface 410 may be adapted to contact block 500, and may be of any size and shape. A non-limiting example of block support surface 410 is shown in FIGS. 3–8. It should be understood that block support surface 410 may be sized slightly larger than block 500, and may include a generally planar surface. Similarly, flange 420 may be of any shape or size, so long as it abuts a lip 385 formed along the bottom portion of rear wall 345 (as shown in FIGS. 5–8).

Figure 5:
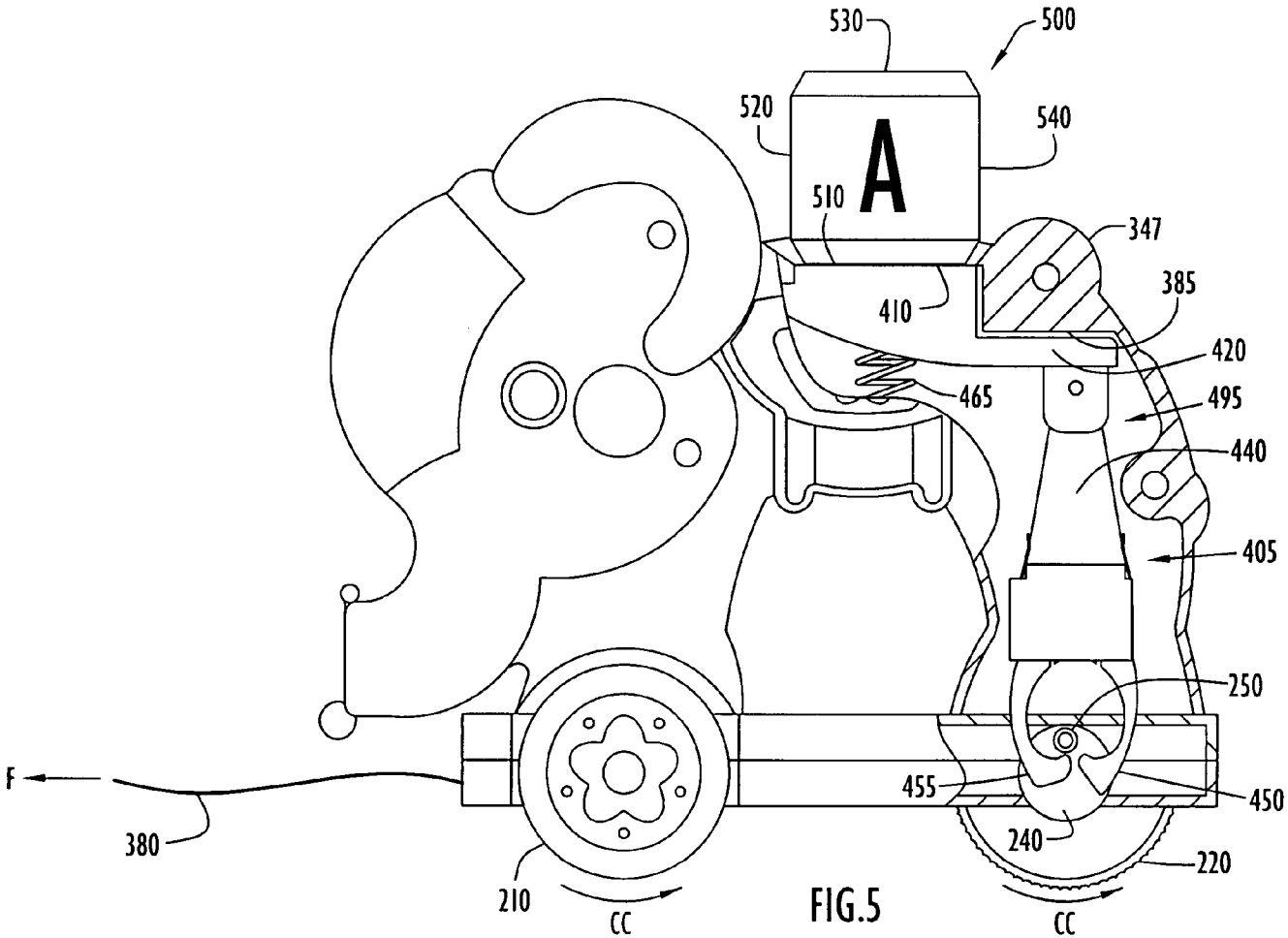
FIGS. 5–8 illustrate partial cross-sectional side views of the device of FIG. 1, showing the mechanism used to impart a controlled motion to an unattached toy block placed on the entertainment device of the present invention as the device is pulled along a supporting surface.
Figure 6:
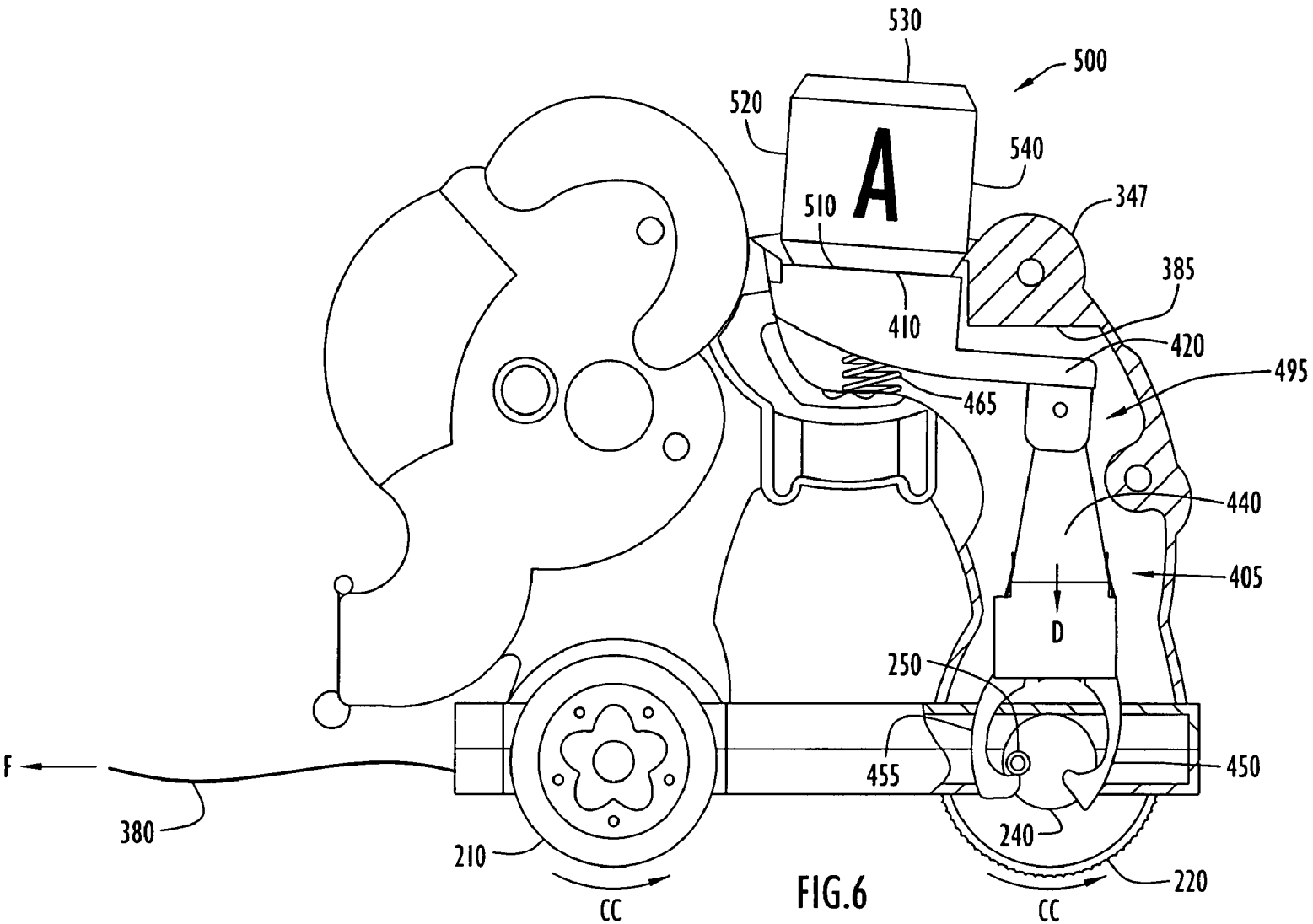

As illustrated in FIG. 3, block support member 495 is pivotally connected to housing 300. Flange 325, formed along the underside of front wall 335, is received in groove 435 formed in the front edge of block support surface 410. Block support member 495 is pivotally mounted to housing 300 via pivot post 430, which is received in pivot receptacle 327 (as shown in dashed lines in FIG. 3). With this configuration, block support surface 410 is capable of pivoting downward from the normal (horizontal) position (as shown in FIGS. 5 and 6). Block support surface 410 is prevented from pivoting upward beyond its normal position due to flange 420 abutting lip 385 formed along the bottom portion of rear wall 345 of housing 300. A spring 465 (shown in FIGS. 5–8) biases block support member 495 toward the normal (horizontal) position.

Figure 4:
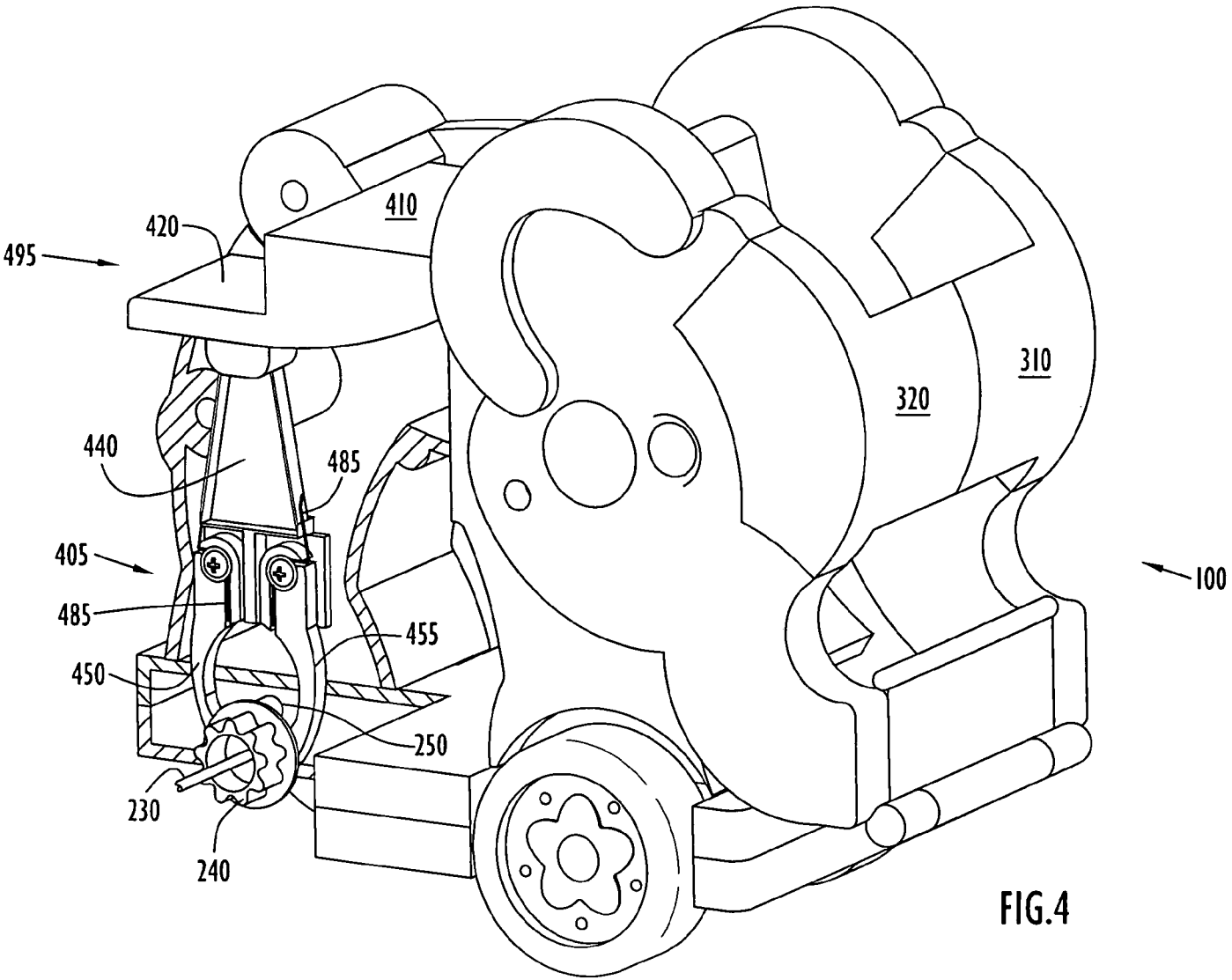
FIG. 4 illustrates a partial cross-sectional perspective view of the device of FIG. 1, showing an embodiment of the mechanism used to impart a controlled motion to an unattached toy block (not shown) placed on the entertainment device of the present invention.

FIG. 4 illustrates a partial cross-sectional perspective view of the device of FIG. 1, showing an embodiment of the mechanism used to impart a controlled motion to an unattached toy block placed on the entertainment device I 00 of the present invention. Referring to FIG. 4, block support member 495 includes reorientation actuator 405 which extends downward from flange 420. Reorientation actuator 405 may include an actuator arm 440 connected to flange 420 and a pair of rounded pincers or hooks 450, 455 pivotally connected to actuator arm 440. Hooks 450, 455 are opposably mounted to actuator arm 440 and are disposed proximate gear 240 on axle 230. Hooks 450, 455 are biased inwardly towards each other via spring clips 485. Hooks 450, 455 are configured to capture offset boss 250 of gear 240 on axle 230.

The movement of device 100 along a surface engages block reorientation mechanism 400 in such a manner that a block accessory 500 positioned on block support surface 410 is propelled off the surface, rotates, and is allowed to return to the block support surface 410. By way of non-limiting example, block reorientation mechanism 400 can be adapted to propel block 500 off of block support surface 410 from a first position in which a first planar surface of block 500 is in contact with block support surface 410 and reorient block 500 to a second position in which a second planar surface of block 500 is in contact with block support surface 410.

FIGS. 5–8 illustrate partial cross-sectional side views of the device of FIGS. 1 and 2, showing the mechanism used to impart a controlled motion to an unattached toy block 500 placed on entertainment device 100 of the present invention as the device 100 is pulled along a supporting surface. Device 100 begins in an initial, stationary position (as illustrated in FIG. 5). Block 500 includes a first block surface 510, a second block surface 520, a third block surface 530, and a fourth block surface 540. In the illustrated embodiment, each of the block surfaces 510, 520, 530, and 540 is a planar surface. Block 500 is positioned such that first block surface 510 contacts block support surface 410 of block support member 495. A force (indicated by arrow F) is then applied to device 100 using, e.g., appendage 380. Alternately, handle 347 may be utilized to apply a force in direction F to the device 100. Force F causes device 100 to move along a supporting surface via the rotation of front 210 and rear 220 wheel pairs. Note that device 100 may be moved forward or backward. A forward motion of device 100 causes wheel pairs 210, 220 to move in a counterclockwise direction (as indicated by arrows CC). Since rear axle 230 (not shown in FIGS. 5–8, but see FIGS. 3 and 4) is fixedly attached to rear wheel pair 220, the rotation of rear wheel pair 220 rotates axle 230. As explained above, gear 240 is fixedly attached to rear axle 230 and, consequently, rotation of axle 230 rotates gear 240. Rotation of gear 240 moves offset boss 250 along a substantially circular (360°) path. As illustrated in FIG. 5, offset boss 250 may be initially located at an uppermost reference position (the 0°/360° position).

Referring to FIG. 6, as device 100 is moved forward, gear 240 is rotated in the counterclockwise direction CC and offset boss 250 travels along its rotational path to engage the end of forward hook 455 of actuator arm 440. This engagement pulls reorientation actuator 405 downward (as indicated by arrow D). Reorientation actuator 405, in turn, pulls flange 420 downward, overcoming the biasing force of block support spring 465. Since block support member 495 is pivotally mounted to housing 300 (as described above with reference to FIG. 3), the downward pulling force D caused by offset boss 250 engaging the end of forward hook 455 causes block support member 495 to pivot downwardly away from lip 385.

Figure 7:
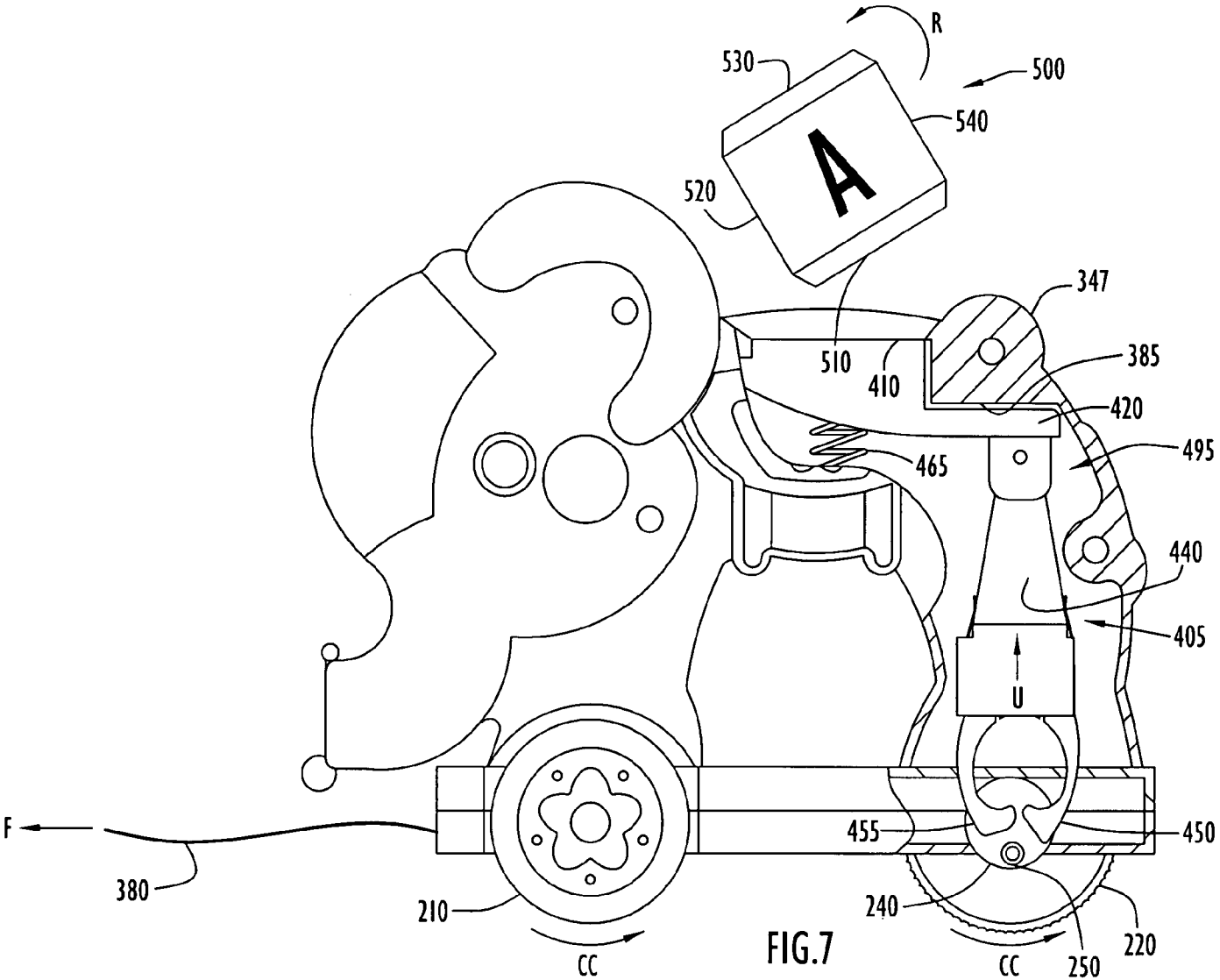

Referring to FIG. 7, as device 100 continues to move (i.e., as the wheels continue to rotate in direction CC), offset boss 250 continues to rotate until it becomes positioned between hooks 450, 455 (e.g., when offset boss 250 is at a lowermost reference position (at about 180° along its rotational path)). As explained above, hooks 450, 455 are biased inwardly towards each other by spring clips 485 (as shown in FIG. 4). As offset boss 250 approaches this lowermost reference position, the inward biasing force applied to hooks 450, 455 by spring clips 485 is overcome by offset boss 250, and the hooks 450, 455 are pushed apart, allowing boss 250 to exit reorientation actuator 405. The downward force D applied by boss 250 to reorientation actuator 405 is removed, and the upward force U provided by support spring 465 forces block support member 495 to quickly pivot upward to its normal (horizontal) position. This upward rotational force R is transferred to block 500, causing it to become airborne, rotate, and return to support surface 410. As explained above in regard to FIGS. 1 and 2, left side wall 355, right side wall 365, front wall 335, and rear wall 345 extend at an at an upward and outward angle relative to block support surface 410. With this configuration, once airborne, should block 500 not land directly back on block support surface 410, instead of landing and balancing on a wall segment, the angled wall segments 335, 345, 355, and 365 will direct block 500 back toward block support surface 410. This configuration helps to maintain block 500 in proximity and in contact with block support surface 410.

Figure 8:
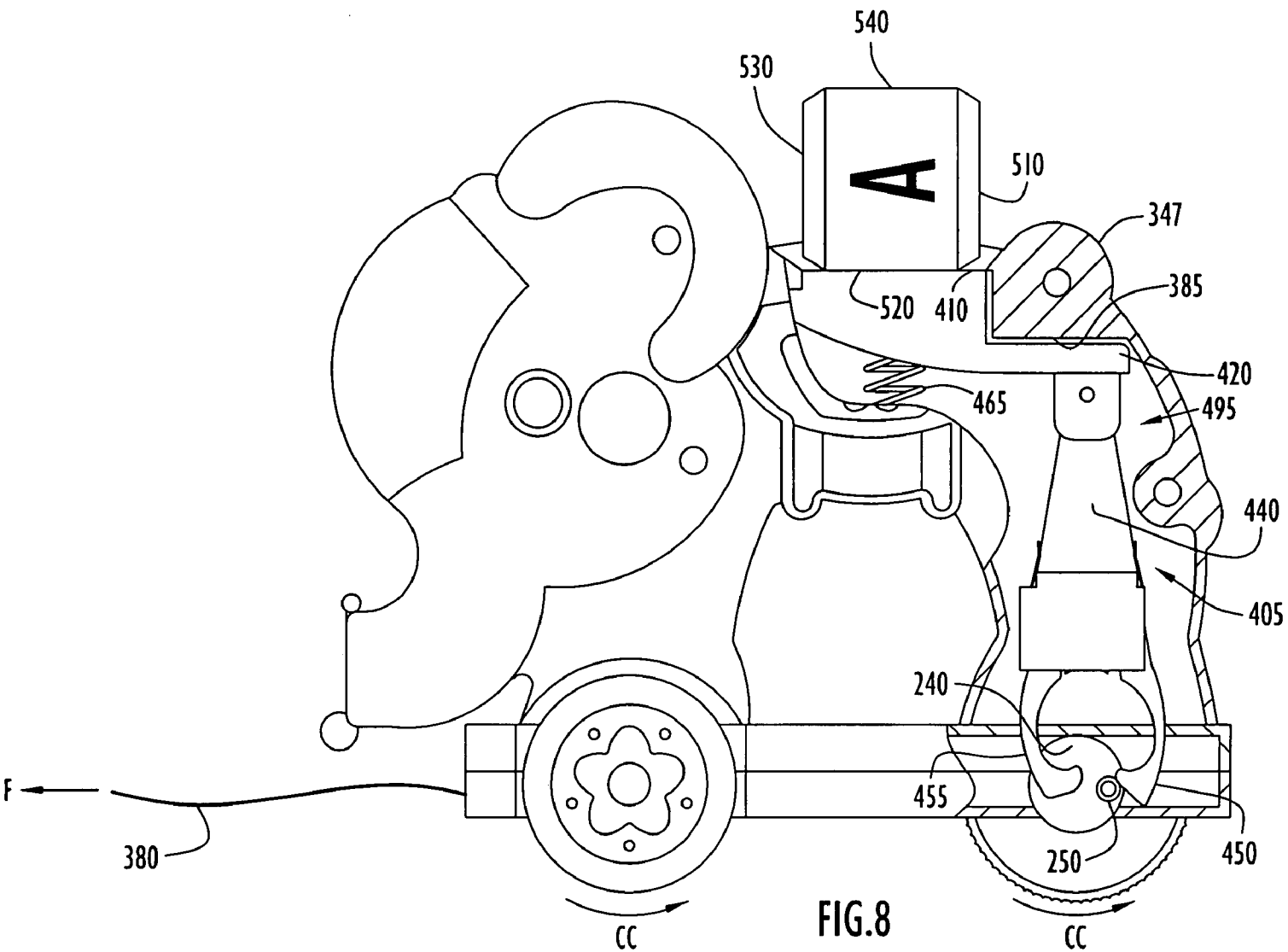

After becoming airborne, block 500 may return to support surface 410 in any position. By way of non-limiting example, block 500 may return to support surface 410 in a position that differs from its original, starting position. As another example, as shown in FIGS. 5–8, block 500 may rotate 90°, starting in a position such that first block surface 510 is in contact with block support surface 410, and ending in a position such that second block surface 520 is in contact with block support surface 410 (as shown in FIG. 8). It is to be understood, however, that block 500 may rotate any rotational amount, including multiples of 90°.

As device 100 continues to be moved along a surface, offset boss 250 continues along its circular, rotational path, traveling back to its uppermost reference position (i.e., the 00/360° position). As offset boss 250 rotates in direction CC from its lowermost reference position (at about 180° along its rotational path), it engages rear hook 450 of reorientation actuator 405 and is directed back between hooks 450, 455. The force of offset boss 250 (caused by the rotational motion of gear 240) again overcomes the inward biasing force of spring clips 485 on hooks 450, 455. Boss 250 pushes hooks 450, 455 outward from each other and reenters the reorientation actuator 405 (i.e., the area between the hooks 450, 455). As device is further moved along a surface, this block reorientation process is repeated over and over.

It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

While the invention has been described in detail and with reference to specific embodiments thereof, it will be apparent to one skilled in the art that various changes and modifications can be made therein without departing from the spirit and scope thereof. For example, device 100 need not be a wheeled vehicle and may simply be a freestanding toy with a manually actuated reorientation mechanism. Furthermore, blocks 500 may be of any suitable size and shape. Furthermore, blocks 500 may include internal entertainment features that are actuated by the reorientation of the block (for example, such as the commercially available blocks sold as the Peek-a-Blocks™ series of stacking blocks available from Fisher-Price, Inc.). Thus, it is intended that the present invention covers the modifications and variations of this invention that come within the scope of the appended claims and their equivalents.

That invention claimed is:

1. An entertainment device for use with at least one toy block, the entertainment device comprising:

a housing mounted on wheels for rolling motion, the housing including a block support surface for a toy block, the toy block including at least first and second planar surfaces adapted to contact the support surface, wherein the housing is configured to permit a user to selectively place the toy block onto the block support surface;

a block reorientation mechanism attached to the housing, the block reorientation mechanism being adapted to (i) propel the block off of the block support surface from a first position in which the first planar surface of the block is in contact with the block support surface and (ii) reorient the block to a second position in which the second planar surface of the block is in contact with the block support surface.

2. The entertainment device of claim 1, wherein the block support surface is planar.

3. The entertainment device of claim 1, wherein the housing includes four side walls which extend upward from the block support surface to maintain the toy block in proximity to the block support surface.

4. The entertainment device of claim 1, wherein the housing includes an open top to permit the user to selectively place the toy block onto the block support surface.

5. The entertainment device of claim 1, wherein the block reorientation mechanism is actuated upon rolling movement of the device on its wheels.

6. The entertainment device of claim 5, wherein at least one of the wheels includes an associated cam surface adapted to actuate the block reorientation mechanism.

7. The entertainment device of claim 1, wherein the device includes an appendage for initiating rolling motion of the device.

8. The entertainment device of claim 1, wherein the block reorientation mechanism is attached to the block support surface and wherein the block support surface is spring biased.

9. The entertainment device of claim 8, wherein the block support surface is pivotally attached to the housing of the device.

10. The entertainment device of claim 1, wherein the block reorientation mechanism is further adapted to rotationally reorient the toy block in multiples of 90 degrees.

11. An entertainment device comprising:

a toy block including at least first and second planar surfaces;

a housing mounted on wheels including a planar block support surface for receiving the toy block, the planar block support surface being adapted to contact either of the first or second planar surfaces of the toy block; and a block reorientation mechanism attached to the block support surface, the block reorientation mechanism adapted to move the toy block from a first position in which the first planar surface of the toy block contacts the planar block support surface to a second position in which the second planar surface of the toy block contacts the planar block support surface, wherein the housing is configured to allow a user to selectively place the toy block on the block support surface.

12. The entertainment device of claim 11 wherein the block reorientation mechanism is further adapted to propel the toy block off of the block support surface from the first position and reorient the block to the second position.

13. The entertainment device of claim 11, wherein the housing includes four side walls which extend upward from the planar block support surface to maintain the toy block in proximity to the planar block support surface.

14. The entertainment device of claim 11, wherein the housing includes an open top to permit the user to selectively place the toy block onto the block support surface.

15. The entertainment device of claim 11, wherein the block reorientation mechanism is actuated upon rolling movement of the device on its wheels.

16. The entertainment device of claim 15, wherein at least one of the wheels includes an associated cam surface adapted to actuate the block reorientation mechanism.

17. The entertainment device of claim 11, wherein the device includes an appendage for initiating rolling motion of the device.

18. The entertainment device of claim 11, wherein the block reorientation mechanism is attached to the block support surface and wherein the block support surface is spring biased.

19. The entertainment device of claim 18, wherein the block support surface is pivotally attached to the housing of the device.

20. The entertainment device of claim 11, wherein the block reorientation mechanism is further adapted to rotationally reorient the toy block in multiples of 90 degrees.

21. An entertainment device for use with at least one toy block, the entertainment device comprising:

a housing including wheels for rolling the device along a surface and means for supporting a toy block, the toy block including at least first and second planar surfaces adapted to contact the block supporting means; and means for propelling the toy block off of the block supporting means from a first position in which the first planar surface of the toy block is in contact with the block supporting means to a second position in which the second planar surface of the toy block is in contact with the block supporting means, wherein the means for propelling the toy block is attached to the block supporting means, and wherein the housing is configured to permit a user to selectively place the toy block onto the block supporting means.

22. The entertainment device of claim 21, wherein the block supporting means is planar.

23. The entertainment device of claim 21, wherein the housing further includes means for maintaining the toy block in proximity to the block supporting means.

24. The entertainment device of claim 23, wherein the means for maintaining the toy block in proximity to the block supporting means comprises a cooperating structure that extends upward from the block supporting means.

25. The entertainment device of claim 21, wherein the housing includes an open top to permit the user to selectively place the toy block onto the block support surface.

26. The entertainment device of claim 21, wherein the means for propelling the toy block off of the block supporting means is actuated upon rolling movement of the device along the surface.

27. The entertainment device of claim 21, wherein the housing includes means for initiating rolling movement of the device along the surface.

28. The entertainment device of claim 27, wherein the means for initiating rolling movement of the device along the surface comprises an appendage attached to the housing for initiating rolling movement of the device.

29. The entertainment device of claim 21, wherein the block supporting means is spring biased.

30. The entertainment device of claim 21, wherein the block supporting means is planar.

31. The entertainment device of claim 21, wherein the block supporting means is pivotally attached to the housing of the device.

32. The entertainment device of claim 21, wherein the means for propelling the toy block off of the block supporting means is adapted to rotationally reorient the toy block in multiples of 90 degrees.

33. An entertainment device for use with a toy block, the entertainment device comprising:

a housing mounted on wheels for rolling motion, said housing including a block support surface for the toy block, the toy block including at least a first planar surface and a second planar surface, each surface adapted to contact the block support surface, wherein the housing includes an open-top structure configured to permit the selective placement or removal of the toy block from the block support surface;

a block reorientation mechanism attached to the housing, the block reorientation mechanism being adapted to (i) propel the toy block off of the block support surface from a first position in which the first planar surface of the block is in contact with the block support surface and (ii) reorient the toy block to a second position in which the second planar surface of the block is in contact with the block support surface.

34. The entertainment device of claim 33, wherein the block support surface is planar and pivotally attached to the housing of the device.

35. The entertainment device of claim 33, wherein the housing includes four side walls extending upward from the block support surface to maintain the toy block in proximity to the block support surface.

36. The entertainment device of claim 33, wherein the block reorientation mechanism is actuated upon rolling movement of the device on its wheels.

* * * * *